US008016042B2

(12) United States Patent
Spiering et al.

(10) Patent No.: US 8,016,042 B2
(45) Date of Patent: Sep. 13, 2011

(54) STRESS DISTRIBUTING WELLHEAD CONNECTOR

(75) Inventors: Michael W. Spiering, Kingwood, TX (US); Maoye Sun, Cypress, TX (US); Paul D. Bunch, Houston, TX (US); Eric D. Larson, Tomball, TX (US)

(73) Assignee: Cameron International Corporation, Houston, TX (US)

( * ) Notice: Subject to any disclaimer, the term of this patent is extended or adjusted under 35 U.S.C. 154(b) by 0 days.

(21) Appl. No.: 12/571,106

(22) Filed: Sep. 30, 2009

(65) Prior Publication Data

US 2010/0078174 A1 Apr. 1, 2010

Related U.S. Application Data

(63) Continuation of application No. 11/445,065, filed on Jun. 1, 2006, now Pat. No. 7,614,453.

(51) Int. Cl.
*E21B 33/038* (2006.01)

(52) U.S. Cl. ..... 166/338; 166/339; 166/351; 166/368; 166/383; 285/364; 285/369

(58) Field of Classification Search ..... 166/338–340, 166/367, 368, 351, 360, 348, 381, 383; 285/364, 285/368, 369, 323
See application file for complete search history.

(56) References Cited

U.S. PATENT DOCUMENTS

| | | | | | |
|---|---|---|---|---|---|
| 2,006,520 | A * | 7/1935 | Stone et al. | ..... | 285/334 |
| 3,210,096 | A * | 10/1965 | Van | ..... | 285/115 |
| 3,346,278 | A * | 10/1967 | Yocum | ..... | 285/333 |
| 4,113,290 | A * | 9/1978 | Miida | ..... | 285/334 |
| 4,346,920 | A * | 8/1982 | Dailey | ..... | 285/89 |
| 4,496,172 | A * | 1/1985 | Walker | ..... | 285/18 |
| 4,582,348 | A * | 4/1986 | Dearden et al. | ..... | 285/148.19 |
| 4,629,222 | A * | 12/1986 | Dearden et al. | ..... | 285/332.4 |
| 4,688,832 | A * | 8/1987 | Ortloff et al. | ..... | 285/148.19 |
| 4,708,376 | A * | 11/1987 | Jennings et al. | ..... | 285/315 |
| 5,174,376 | A * | 12/1992 | Singeetham | ..... | 166/208 |
| 5,522,681 | A * | 6/1996 | Pallini, Jr. | ..... | 405/223.1 |
| 6,070,669 | A * | 6/2000 | Radi et al. | ..... | 166/368 |
| 6,283,511 | B1 * | 9/2001 | Kamp | ..... | 285/391 |
| 6,293,343 | B1 * | 9/2001 | Pallini et al. | ..... | 166/345 |
| 6,540,024 | B2 * | 4/2003 | Pallini et al. | ..... | 166/348 |
| 6,609,731 | B2 * | 8/2003 | DeBerry et al. | ..... | 285/123.4 |
| 6,843,508 | B2 * | 1/2005 | Cords et al. | ..... | 285/148.19 |
| 7,040,407 | B2 * | 5/2006 | Jennings et al. | ..... | 166/348 |
| 7,107,663 | B2 * | 9/2006 | Ellington et al. | ..... | 29/523 |
| 7,380,607 | B2 * | 6/2008 | Thomas | ..... | 166/348 |

* cited by examiner

*Primary Examiner* — Thomas A Beach
*Assistant Examiner* — Matthew R Buck
(74) *Attorney, Agent, or Firm* — Fletcher Yoder

(57) ABSTRACT

In accordance with certain embodiments, the present invention provides a connector for attaching to a multi-toothed profile on a wellhead features a tooth profile that staggers loading preferably starting at a loading surface furthest from the connector body sitting on the wellhead and moving toward the connector body. The staggered loading more evenly distributes stresses on the matching loading surfaces as compared to the result of using a tooth profile on the connector that nearly exactly matches the profile on the wellhead. The joint can then take advantage of an increased preload and exhibit improved stress characteristics when operating at high loading conditions.

19 Claims, 6 Drawing Sheets

STRESS DISTRIBUTING WELLHEAD CONNECTOR

CROSS-REFERENCES TO RELATED APPLICATIONS

This application is a continuation of U.S. patent application Ser. No. 11/445,065, entitled "Stress Distributing Wellhead Connector", filed on Jun. 1, 2006, now U.S. Pat. No. 7,614,453, which is herein incorporated by reference in its entirety.

STATEMENT REGARDING FEDERALLY SPONSORED RESEARCH OR DEVELOPMENT

Not Applicable.

BACKGROUND

In accordance with certain embodiments, the present invention relates to the field of connectors that attach to multi-toothed profiles on subsea wellheads and, more particularly, to connector profiles that better distribute stress among the teeth to strengthen the connection.

Connectors are employed to attach certain types of equipment to wellhead housings. One common example provides attaching blowout preventer equipment to a subsea wellhead. Bodies that house a blowout preventer are connected to a wellhead. Early designs of such a connection involved a generally C-shaped clamp that was forced to move radially to capture a pair of spaced flanges on the wellhead and the body of the blowout preventer. One example of this single contact surface for this type of collet connector is shown in U.S. Pat. No. 3,096,999. Another form of engagement uses a series of contact surfaces performing a similar connecting function as single surface, but the loading is now distributed on the multiple surfaces available. A common example of this connection kind is the Vetco H4 wellhead. Connector designs in the past may have varied in actuation techniques or size and shape of locking dogs, but one thing they all had in common was that the tooth profile was designed to match the wellhead profile for the size and spacing of engaging teeth. Some examples of such closely matched connector profiles to the wellhead profiles can be seen in DX series connectors offered by Drill Quip, H-4 connectors from ABB Vetco Gray and similar products from Cameron. These products featured a group of radially moving dogs where the tooth profile on the dog matches the wellhead tooth profile, and an angled ring drove the profiles together to connect a body to the wellhead.

This practice has gone on for years without recognition of a limitation of such minor image tooth profile designs in wellhead connector art. The problem not heretofore realized and addressed by the present invention is that using a minor image tooth profile on the locking dog results in an unequal distribution of stress and contact forces on the loading surfaces, with the loading surface closest to the connector body on the locking collet and wellhead bearing a disproportionately large percentage of the stress and contact force among the loading surfaces. This occurs because from a common reference line on the locking collet the loading surface closest to the reference line experienced the lowest percentage elongation and thus carried more of the stress than loading surfaces progressively further from a common and stationary reference line. The elongation of the dog and compression of the wellhead makes the loads progressively lower for each tooth profile further from a common reference line.

The present invention, exemplary embodiments of which are discussed below, provides various benefits and abates various concerns, such as the concerns addressed above.

SUMMARY OF THE INVENTION

In accordance with certain embodiments, the present invention puts forward a staggered contact design where contact is first established at the lowermost end of the collet or dog and on the wellhead at a location furthest from the preventer body. Then, as the collet or dog is powered to move radially inwardly, additional loading surfaces come into contact in a direction approaching the connector body.

As further exemplary embodiments, the present invention provides a connector for attaching to a multi-toothed profile on a wellhead, the connector featuring a tooth profile that initially staggers loading starting at a loading surface furthest from the preventer body sitting on the wellhead and moving toward the preventer body. The staggered loading more evenly distributes stresses at the preloaded condition on the matching loading surfaces as compared to the result of using a tooth profile on the connector that nearly exactly matches the profile on the wellhead. The joint can then handle higher operating pressures and external loads with reduced risk of connection failure. Of course, the foregoing are just examples of the present invention and are not intended to limit the appended claims to the embodiments described.

These and other features of the present invention will be more readily understood by those skilled in the art from a review of the drawings and the description of the exemplary embodiments provided below. Finally, the claims that later appear are indicative of the full scope of the present invention.

DETAILED DESCRIPTION OF THE DRAWINGS

These and other features, aspects, and advantages of the present invention will become better understood when the following detailed description is read with reference to the accompanying drawings in which like characters represent like parts throughout the drawings, wherein.

DETAILED DESCRIPTION

Figure 1:
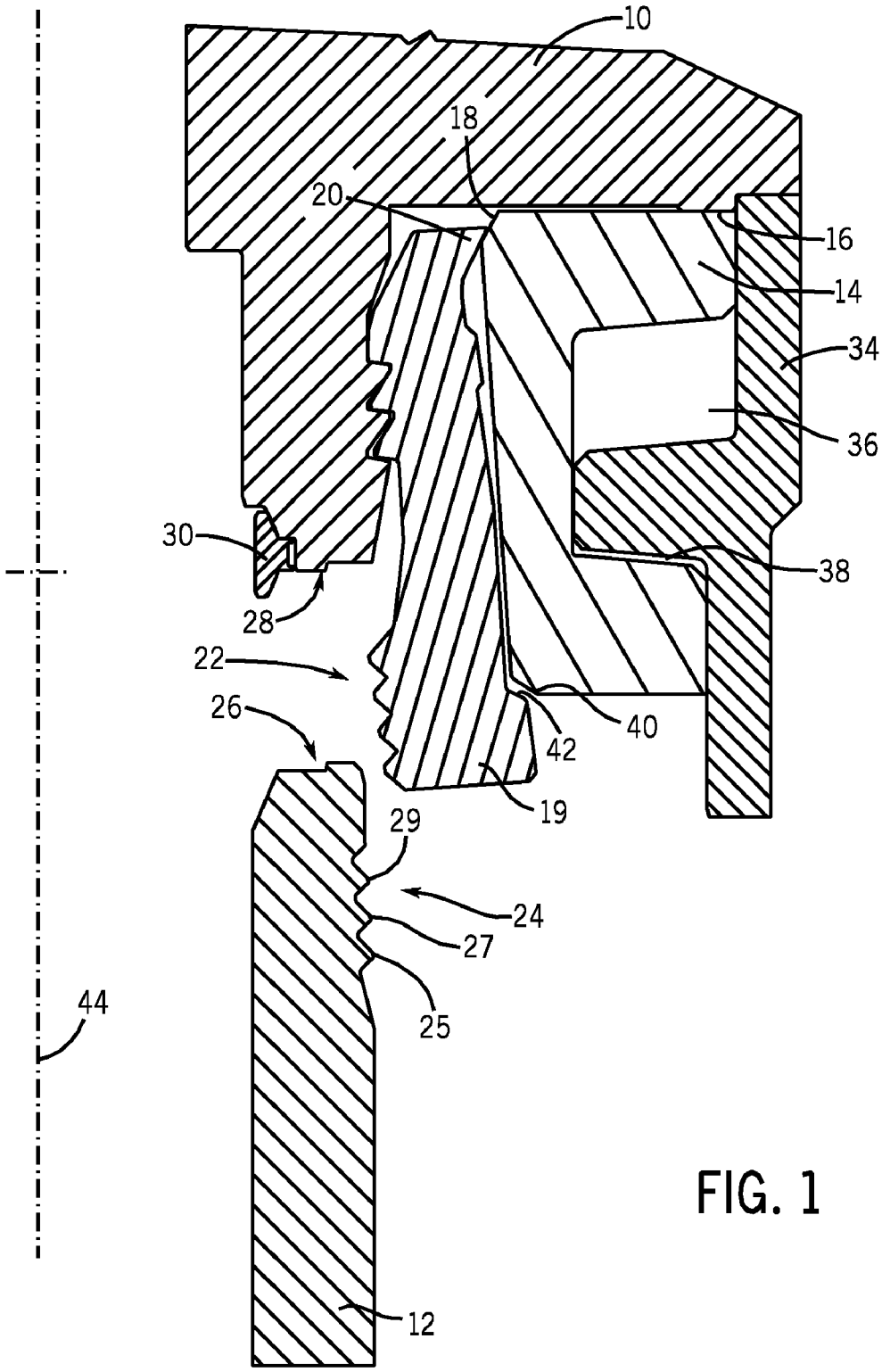
FIG. 1 is a section view of an exemplary connector in the fully open position.
Figure 2:
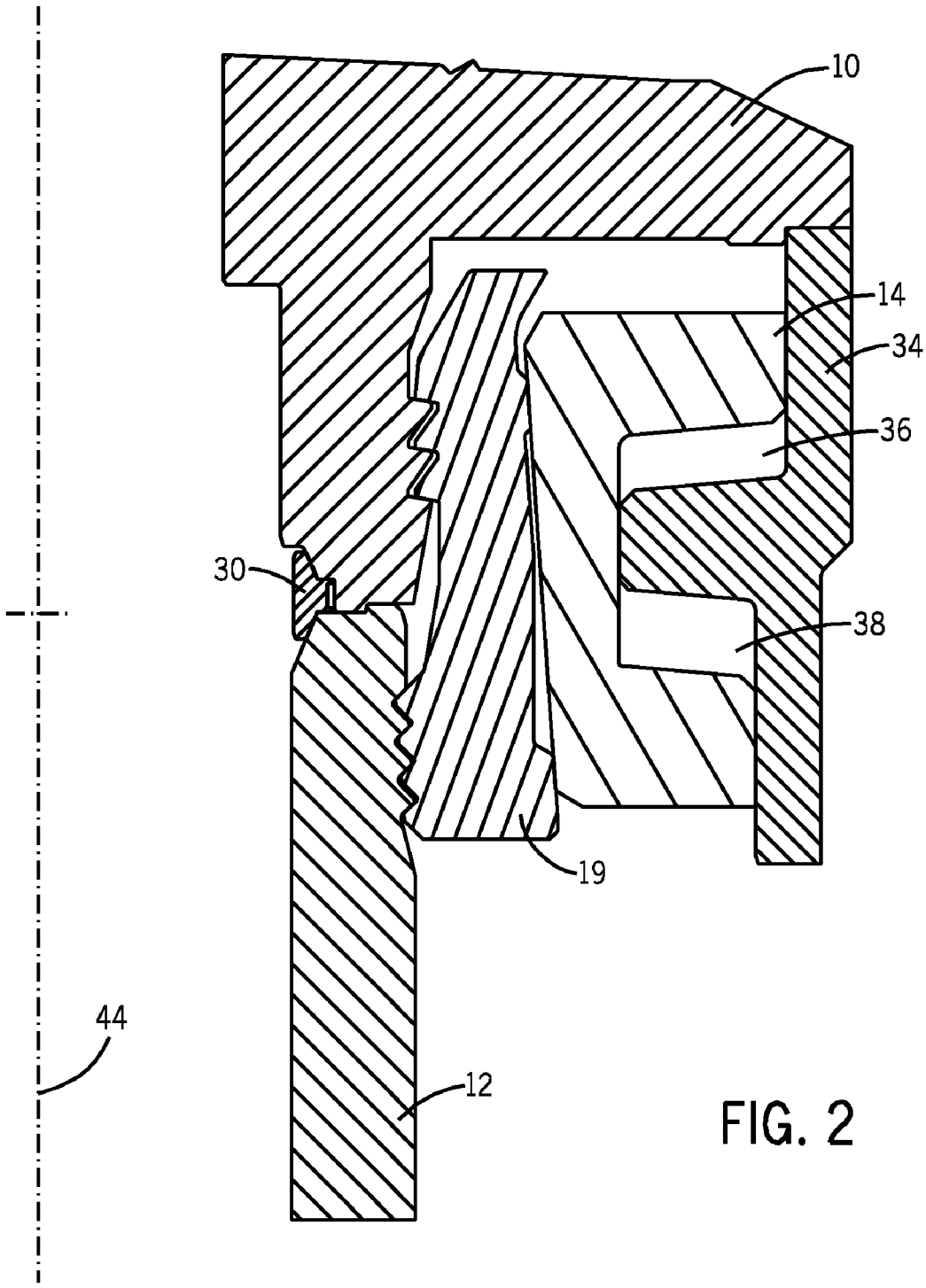
FIG. 2 is the view of the connector of FIG. 1 in the closed position.
Figure 3:
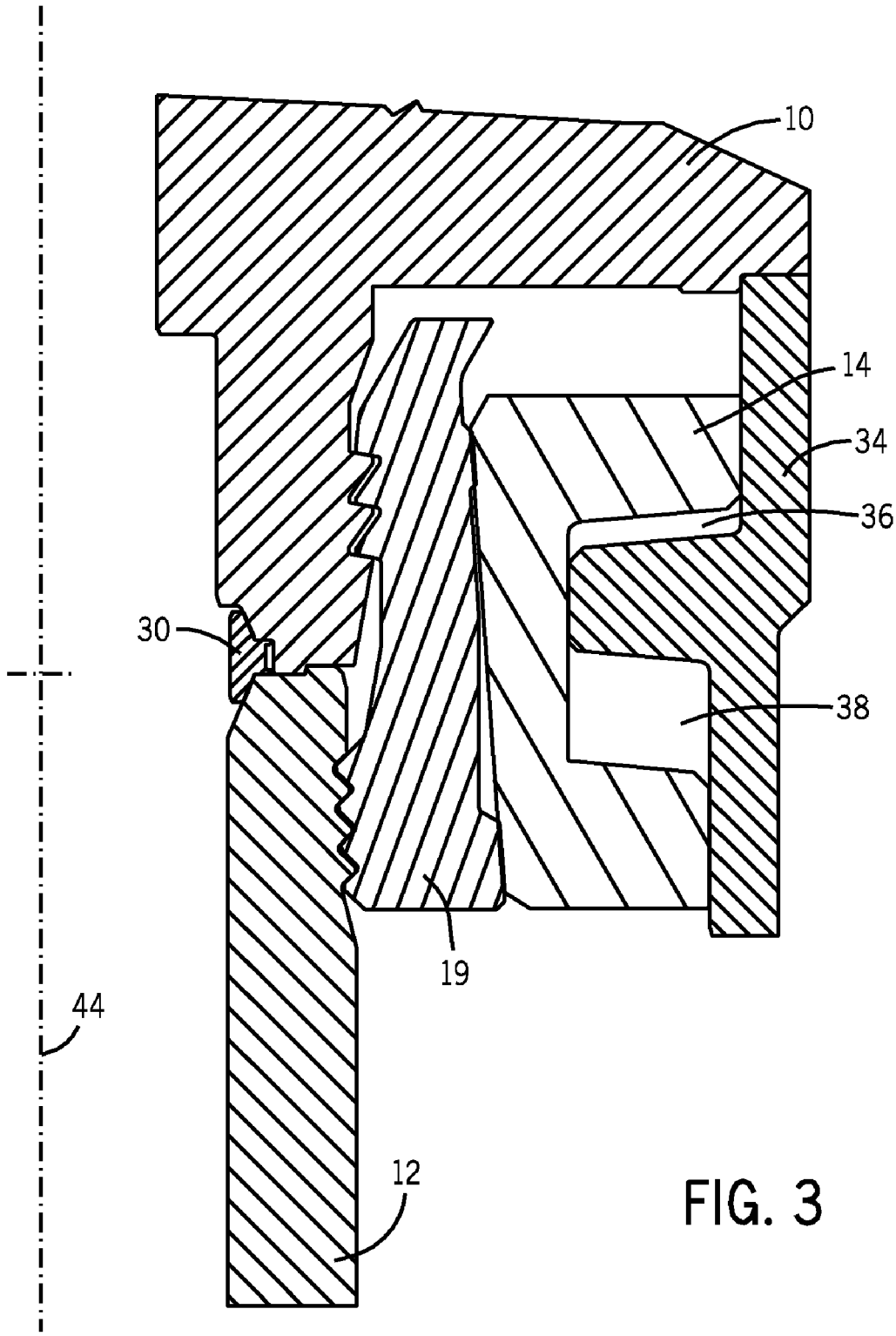
FIG. 3 is the view of the connector of FIG. 2 in the full preload position.

FIGS. 1-3 show the basic structure of an exemplary embodiment in 3 positions. When the body 10 is lowered onto the wellhead 12 the actuator piston 14 is abutting the surface 16 on body 10. The body 10 may facilitate connection of any number of components to the wellhead 12. Indeed, the body 10 may facilitate connection of a production tree, a blow-out-preventer, drilling-tools, among various kinds of tubular devices for oilfield use, to the wellhead. A taper 18 on piston 14 engages extending point 20 to retract the lower teeth 22 away from mating teeth 24 on the wellhead 12. This allows the body 10 to be lowered without the weight of it being supported on teeth 24. The top 26 of the wellhead 12 has a shape that, in this embodiment, conforms to the lower end 28 of body 10 so that when they go together, as shown in FIG. 2, the interface between surfaces 26 and 28 can be sealed by a seal 30. Piston 14 resides in housing 34 which defines two compartments 36 and 38 that are isolated from each other and sealed to accept hydraulic pressure for urging the collets 19 between the positions in FIGS. 1-3. Tapered surfaces 40 and 42 ride on each other as piston 14 moves down to force the collets 19 to move radially toward centerline 44.

The relation of the parts and the movements to secure the body 10 to the wellhead 12, in general, is by way of background to the invention, as the invention is addressed to the relation between the teeth 22 and 24. Those skilled in the art will know that most wellheads feature a tooth pattern 24 that has become an industry standard. The collet tooth pattern 22 thus forms a relationship to this industry standard pattern 24. The industry standard pattern 24 features a series of parallel ridges 25, 27 and 29. These generally are at a common fixed distance as between adjacent ridges. That said, embodiments of the present invention envision connecting to a variety of profiles in wellheads 12 that are commercially available or will be available in a manner that better distributes stress and contact forces as compared to currently available connector designs that emphasize a mirror image of the wellhead pattern on the collet that engages to it. Thus reference to teeth or engaging surfaces is not intended to be limited to particular existing wellhead patterns. Rather, such references relate to designs of interacting multiple surface assemblies that engage each other to attach a body such as a blowout preventer body to a wellhead.

Figure 4:
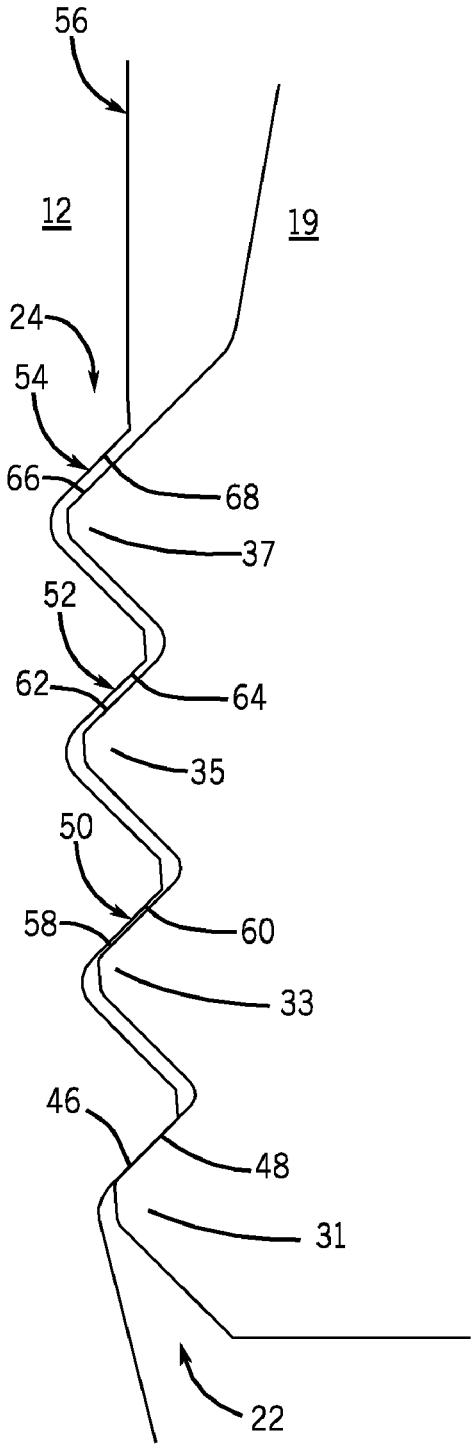
FIG. 4 is an exemplary close up view of the initial tooth contact.
Figure 5:
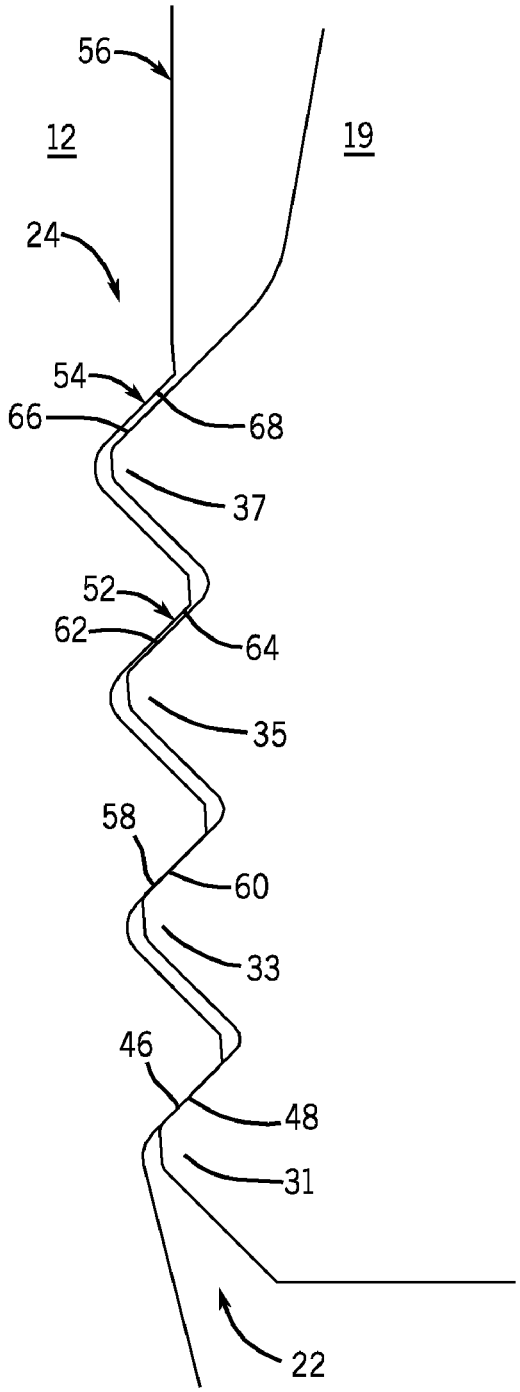
FIG. 5 is the view of FIG. 4 showing the start of radial movement of the collet.
Figure 6:
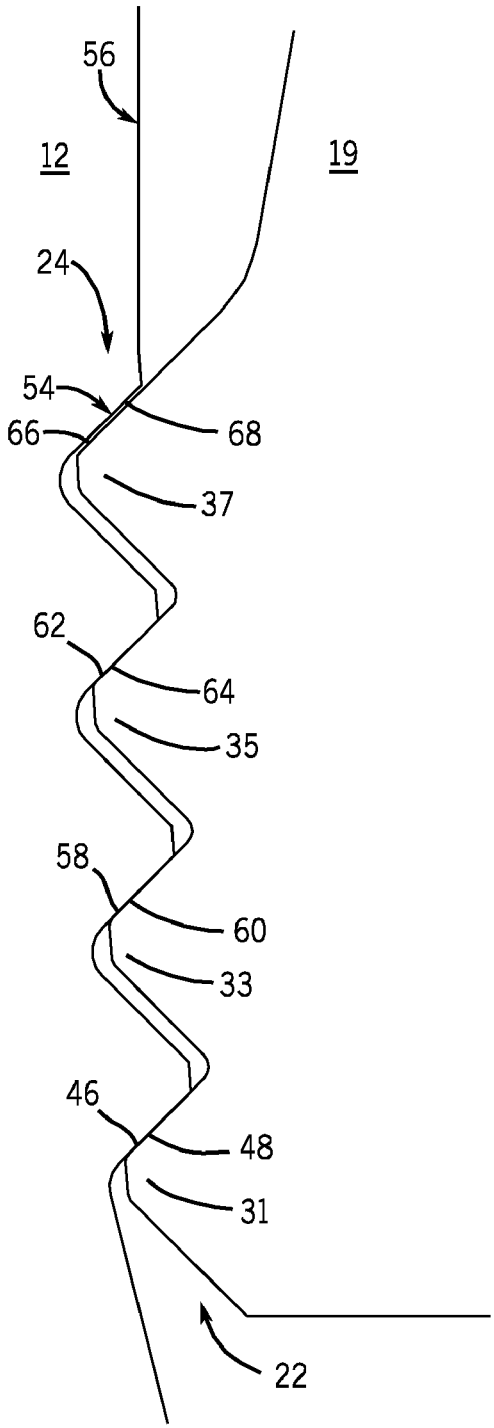
FIG. 6 is the view of FIG. 5 illustrating additional radial collet movement.
Figure 7:
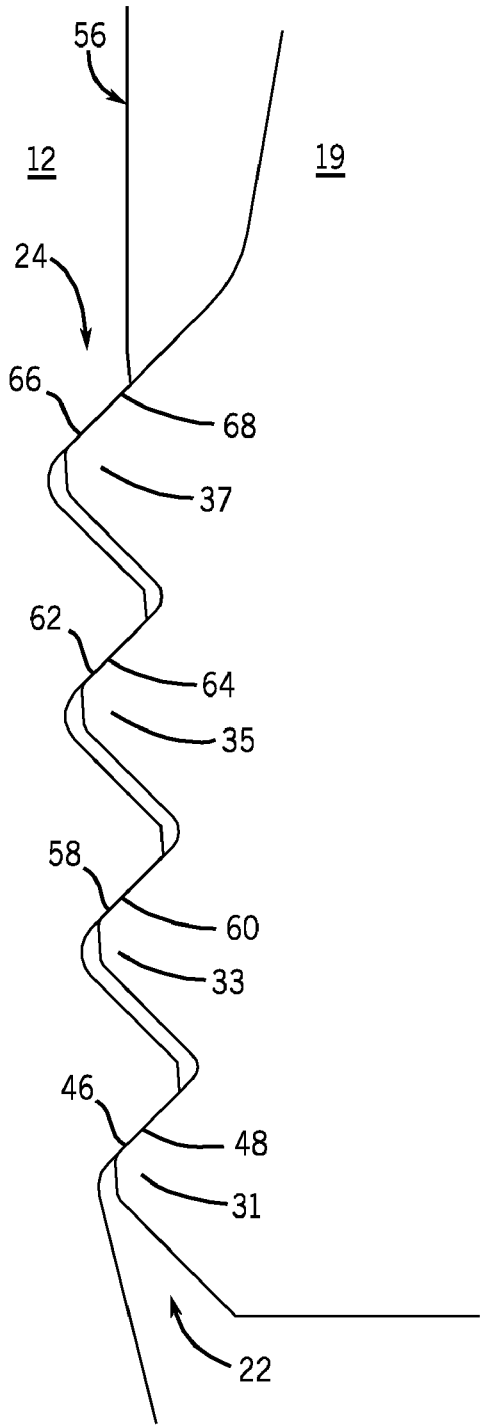
FIG. 7 is the view of FIG. 6 with radial collet movement completed.

Referring now to FIG. 4, the initial contact is by surface 46 on surface 48. At that point there are preferably gaps 50, 52 and 54 that are progressively larger as they are positioned closer to the upper end 56 of wellhead 12. As the collets move radially to start to apply preload, FIG. 5 illustrates that gap 50 has disappeared while gaps 52 and 54 still exist. Further radial movement of collets 19 shown in FIG. 6 shows only gap 54 remains. Finally in FIG. 7, all the gaps are gone as the radial movement of the collets 19 is finished. One reason this happens is that the spacing between adjacent teeth 31, 33, 35 and 37 on the collets 19 is not uniform. In the exemplary embodiment this spacing decreases as between adjacent teeth in a direction going toward upper end 56.

There are variations to the pattern in the FIGS. 4-6. For example, initial contact can leave only gaps 52 and 54 which then close up in series in a direction toward upper end 56. Alternatively, only gap 54 can be present at initial contact. To get stress distribution that is more equalized between or among loading surfaces the contact is preferably sequenced in at least two steps with the first being an initial contact location and the next being contact at another load surface preferably spaced between the initial contact location and the upper end 56 of the wellhead 12.

In the loading shown in FIGS. 4-7, when surfaces 58 and 60 begin contact, surfaces 46 and 48 have already been in contact and have had relative sliding movement between them. When surfaces 62 and 64 begin to contact, surfaces 58 and 60 have increased the stress level from their initial contact and surfaces 46 and 48 now also have greater stress than when they initially contacted and when surfaces 58 and 60 made initial contact. This pattern continues as surfaces 66 and 68 make contact.

The end result of this sequential contact is the stress and load distribution on the mating tooth profiles 22 and 24 is more balanced from top to bottom instead of being more concentrated toward the upper end 56 of wellhead 12. The prior designs featuring symmetrical tooth patterns for the collets and the wellhead stressed the uppermost teeth in the profile significantly more than the teeth closer to the collet lower end, where, for example surfaces 46 and 48 are located. By staggering the contact in a pattern using a plurality of pairs of contact surfaces from the downhole to the uphole direction, the resulting stress distribution is more uniform, improving the preload and increasing the integrity of the connection at higher loading conditions.

Figure 8:
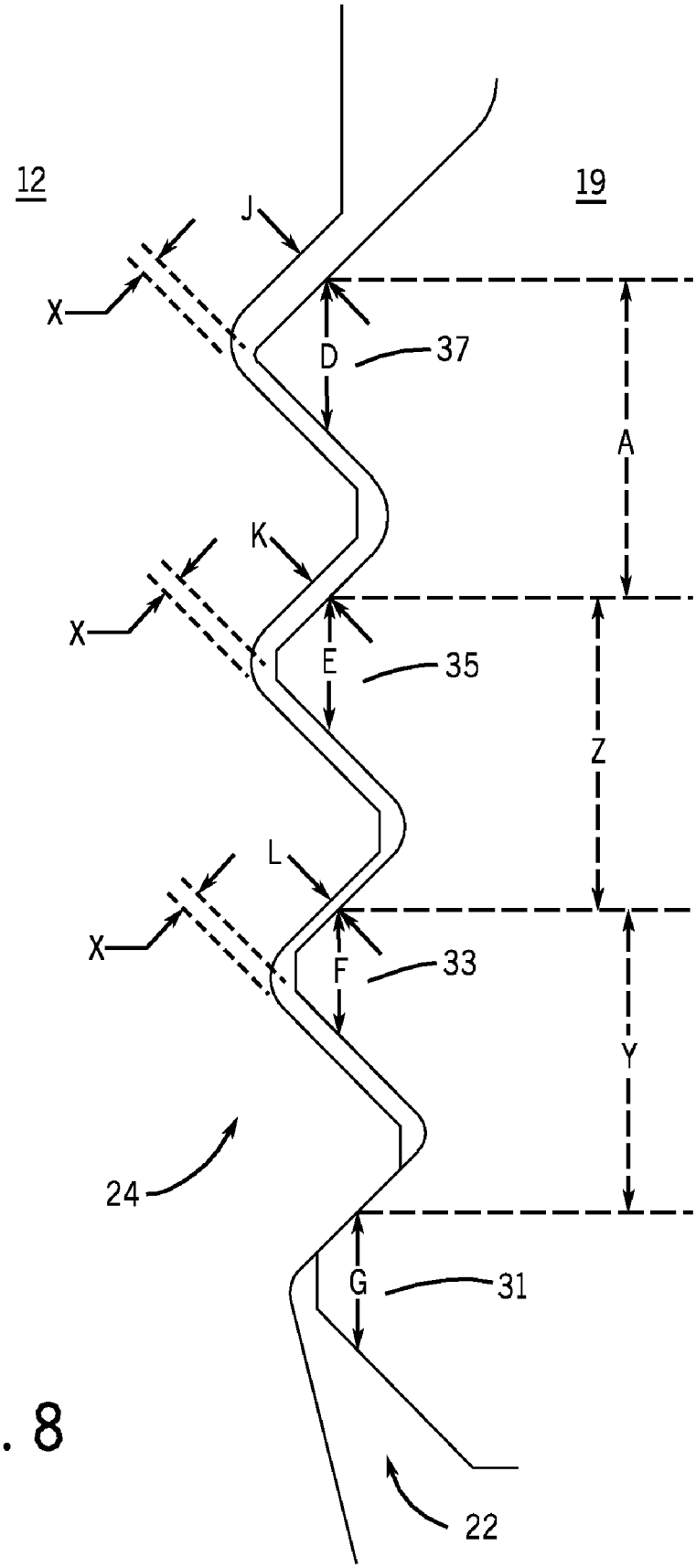
FIG. 8 is a detail view of an exemplary connector assembly.

Turning to FIG. 8, this figure illustrates in detail view an exemplary collet 19 in relation to, for example, a wellhead 12 it secures to. As illustrated, the mating teeth 24 on the wellhead 12 engage with the teeth 22 on the connector 19. The teeth 22 on the connector comprise a lower tooth 31, a lower intermediate tooth 33, an upper intermediate tooth 35, and an upper tooth 37. The number of teeth may be increased or decreased as desired. Moreover, although the lower tooth 31 is illustrated as initiating contact with the wellhead, the tooth of initial contact may be one of the other teeth, depending on the particular mechanics of the system, for instance. For example, the lower intermediate tooth 33 may be the tooth of initial contact.

With respect to these exemplary teeth, and incorporating any slope relationship that may be present with respect to these teeth, certain profile characteristics are present. For example, the distance from a given point on a ridge of a tooth to a corresponding point on a ridge of the same slope-polarity on the adjacent tooth decreases when progressing from a lower tooth to an upper tooth. For instance, in the illustrated embodiment, the distance represented by "Y" is greater than the distance represented by "Z", and the distance represented by "Z" is greater than the distance represented by "A." As another characteristic, the intermediate lower tooth 33 is thicker (distance "F": the distance from a point on a ridge to the corresponding point on the opposite ridge on the same tooth) than upper intermediate tooth 35 (distance "E"). Moreover, upper intermediate tooth 35 is thicker than upper tooth 37 (distance "D").

As a result of the arrangement presented in this figure, the gap represented by "J" is larger than that represented by "K", and the gap represented by "K" is larger than "L". Conversely, the distances represented by "X" are constant. Advantageously, an arrangement as such, as but one example, provides for the staggered engagement discussed above.

The above description is illustrative of the exemplary embodiments, and many modifications may be made by those skilled in the art without departing from the invention whose scope is to be determined from the literal and equivalent scope of the claims below. Again, the above description is illustrative of exemplary embodiments, and many modifications may be made by those skilled in the art without departing from the invention whose scope is to be determined from the literal and equivalent scope of the claims below.

The invention claimed is:

1. A mineral extraction system, comprising:

a collet connector, comprising:

a first plurality of teeth; and a second plurality of teeth axially offset from the first plurality of teeth; and a piston comprising a first axial position axially offset from a second axial position, wherein the first axial position of the piston is configured to bias the first plurality of teeth radially against a third plurality of teeth on a first tubular, the second axial position of the piston is configured to bias the second plurality of teeth radially against a fourth plurality of teeth on a second tubular, the second plurality of teeth has a first series of axial spaces between successive pairs of teeth, the fourth plurality of teeth has a second series of axial spaces between successive pairs of teeth, and the first and second series of axial spaces are different from one another.

2. The system of claim 1, wherein the first axial position of the piston is configured to hold the second plurality of teeth at a radial offset position relative to the fourth plurality of teeth, and the second axial position of the piston is configured to hold the first plurality of teeth radially against the third plurality of teeth.

3. The system of claim 1, comprising a housing sealed around the piston, wherein the piston extends around the collet connector, the piston and the housing have a first annular compartment that is configured to receive a first fluid to bias the piston from the first axial position to the second axial position, and the piston and the housing have a second annular compartment that is configured to receive a second fluid to bias the piston from the second axial position to the first axial position.

4. The system of claim 1, wherein the piston comprises a first tapered surface axially offset from a second tapered surface, the first tapered surface is configured to mate with a third tapered surface on the collet connector to bias the first plurality of teeth radially against the third plurality of teeth, and the second tapered surface is configured to mate with a fourth tapered surface on the collet connector to bias the second plurality of teeth radially against the fourth plurality of teeth.

5. The system of claim 4, wherein the piston comprises a fifth tapered surface axially between the first and second tapered surfaces, the collet connector comprise a sixth tapered surface axially between the third and fourth tapered surfaces, and the fifth and sixth tapered surfaces are configured to engage one another at least during a transition between the first and second axial positions of the piston.

6. The system of claim 1, wherein the first series of axial spaces progressively decreases between successive pairs of teeth in the second plurality of teeth, and the second series of axial spaces is uniform between successive pairs of teeth in the fourth plurality of teeth.

7. The system of claim 1, wherein a difference in the axial spaces between the first and second series of axial spaces is progressively greater between successive pairs of teeth in the second and fourth plurality of teeth.

8. The system of claim 1, wherein the collet connector is configured to pivot in response to movement of the piston between the first and second axial positions.

9. The system of claim 1, comprising the first tubular, the second tubular, or a combination thereof.

10. The system of claim 1, comprising the second tubular, wherein the second tubular comprises a wellhead.

11. A mineral extraction system, comprising:

a collet connector, comprising:

a first plurality of teeth configured to couple with a third plurality of teeth on a first tubular at a first interface; and a second plurality of teeth configured to couple with a fourth plurality of teeth on a second tubular at a second interface, wherein the second plurality of teeth has a first series of axial spaces between successive pairs of teeth, the fourth plurality of teeth has a second series of axial spaces between successive pairs of teeth, and the collet connector is configured to pivot toward the second interface to sequentially engage the second and fourth plurality of teeth based on sequentially greater differences in the axial spaces between the first and second series of axial spaces.

12. The system of claim 11, comprising a radial actuator comprising first and second actuation positions, wherein the first actuation position is configured to radially bias a first end portion of the collet connector to couple the first and third plurality of teeth, and the second actuation position is configured to radially bias a second end portion of the collet connector to couple the second and fourth plurality of teeth.

13. The system of claim 12, wherein the radial actuator comprises an annular hydraulic piston extending around the collet connector.

14. The system of claim 11, wherein the first series of axial spaces progressively decreases between successive pairs of teeth in the second plurality of teeth, and the second series of axial spaces is uniform between successive pairs of teeth in the fourth plurality of teeth.

15. The system of claim 11, wherein the first plurality of teeth comprise first tapered teeth, the second plurality of teeth comprise second tapered teeth, the third plurality of teeth comprise third tapered teeth, and the fourth plurality of teeth comprise fourth tapered teeth.

16. A mineral extraction system, comprising:

a collet connector comprising a first plurality of teeth having a first series of axial spaces between successive pairs of teeth; and a tubular comprising a second plurality of teeth having a second series of axial spaces between successive pairs of teeth, wherein the collet connector is configured to move in a radial direction to sequentially engage the first and second plurality of teeth based on sequentially greater differences in the axial spaces between the first and second series of axial spaces, wherein the collet connector is configured to pivot to sequentially engage the first and second plurality of teeth based on sequentially greater differences in the axial spaces between the first and second series of axial spaces.

17. The system of claim 16, comprising an annular hydraulic piston configured to bias the collet in the radial direction toward the tubular, wherein the annular hydraulic piston extends around the collet connector.

18. The system of claim 16, wherein the first plurality of teeth comprise first tapered teeth, and the second plurality of teeth comprise second tapered teeth.

19. The system of claim 16, wherein the collet connector comprises a third plurality of teeth axially offset from the first plurality of teeth, and the third plurality of teeth is configured to couple with a fourth plurality of teeth on another tubular.

* * * * *